US005647186A

United States Patent [19]

Donaldson

[11] Patent Number: 5,647,186

[45] Date of Patent: Jul. 15, 1997

[54] STEEL FRAMING SYSTEM FOR WALLS

[76] Inventor: Ronald Arthur Donaldson, 54 Yeovill Drive, Bomaderry, New South Wales, 2541, Australia

[21] Appl. No.: 585,182

[22] Filed: Jan. 11, 1996

[30] Foreign Application Priority Data

| | | | |
|---|---|---|---|
| Jan. 11, 1995 | [AU] | Australia | PN0515 |
| May 12, 1995 | [AU] | Australia | PN2927 |
| Nov. 8, 1995 | [AU] | Australia | 36696/95 |

[51] Int. Cl.[6] ..... E04H 12/00

[52] U.S. Cl. ..... 52/653.1; 52/656.1; 403/363

[58] Field of Search ..... 52/653.1, 656.1, 52/656.2, 656.9, 696, 241, 238.1, 290, 690, 481.1, 481.2; 403/363, 382, 230

[56] References Cited

U.S. PATENT DOCUMENTS

| | | | |
|---|---|---|---|
| 2,699,669 | 1/1955 | Nelsson | 52/241 |
| 4,058,951 | 11/1977 | Dean | 52/656.1 |
| 4,835,935 | 6/1989 | Murphy | 403/382 X |
| 5,515,660 | 5/1996 | Hanks et al. | 52/481.2 X |

FOREIGN PATENT DOCUMENTS

| | | | |
|---|---|---|---|
| 6262290 | 3/1991 | Australia . | |
| 1229889 | 9/1960 | France | 52/556 |

*Primary Examiner*—Creighton Smith
*Attorney, Agent, or Firm*—Edwin D. Schindler

[57] ABSTRACT

An elongate wall frame member (10, 20) comprising: a web portion (11, 21) having a central channel (12, 22) and two base portions (13, 23) on either side of the channel (12, 22); two side edge flange portions (14, 24) both extending substantially perpendicularly and in the same direction from outer side edges of the base portions (13, 23) with the central channel (12, 22) in the web portion projecting in the same direction of the two side edge flange portions (14, 24). At least one end of the elongate wall frame member (10, 20) has part of its web portion (11, 21) notched therefrom so that the elongate wall frame member (10, 20) can be joined at its end to a position along the length of a perpendicularly abutting other one elongate wall frame member (10, 20) whereby the part (18, 28) of the web portion (11, 21) notched therefrom corresponds to either the central channel (12, 22) or the two base portions (13, 23) of the web portion (11, 21) when so joined.

14 Claims, 8 Drawing Sheets

STEEL FRAMING SYSTEM FOR WALLS

The present invention relates to improvements in elongated structural members for use in load bearing quadrilateral frameworks and, in particular, to steel structural members which are cold formed by roll forming and which are ideally joined with connecting steel structural members and the structural masonry, cladding and the like, by nailing. Quadrilateral frameworks are the frameworks of the kind having a parallel arrangement of specifically designed structural members encased at each of their longitudinal extremities by complimentary perpendicular encasing structural members. The present invention therefore specifically relates to the framework members which are cold formed from sheet metal having regard to the form of the members themselves, the method of manufacture of the members comprising the frameworks, the nature of the joints between the members in the frameworks, the method of manufacture of the frameworks and the method of construction of a building or like structure using the frameworks in conjunction with other building materials.

BACKGROUND TO THE INVENTION

It is known to use elongate structural members that are cold rolled from sheet metal to form typically open C-channel sections having a web with flanges projecting from the web edges. These C-channels normally have protective zinc based coatings and are substantially light weight due to the use of light gauge material. Such structural members are usually used in domestic housing, industrial and commercial buildings. When they are used as domestic housing wall frames, the series of regularly spaced parallel vertical structural members in the framework are commonly known as studs while the horizontal or complimentary encasing members are commonly known as plates. The plates can be used to form heads and sills for door openings and window openings respectively.

Frameworks made from these known C-channel members are generally formed by nesting an open C-channel member in a mating C-channel member. This is achieved by having the internal dimensions of the plate matching the external dimensions of the mating studs, and in this way, all the C-channel members have square cut ends. As an example, stud members nest in plate members and noggin members nest in stud members.

Connections made between members of these types are generally made by welds, clinches, bolts, screw, rivets and the like. The use of nails which is the preferred connections between timber structural members is unacceptable for connections between these structural steel members. The use of nails is considered the most efficient means of connection between structural members, however, in nailing timber stud members to timber plate members, the connection is made by driving the nails through the rear of the plate members into the end of the stud members parallel to the longitudinal axes of the stud members. This results in the strength of the joint in the direction of the longitudinal axis of the stud to be dependent on the clamping action of the timber fibres on the shank of the nail. This connection requires reinforcement by metal strapping when the loading on the connection is applied in instances such that the connection is a bracing point and when uplift loading is experienced from wind uplift pressures on sheeted roofs and the like. It has been found that connections incorporating nails in this way are relatively inefficient because the inherent strength of the steel nail is not used whereby the strength of the clamping action on the shank of the nail is less than the tensile strength of the nail. Similarly, the shear capacity of the nail is not being maximised in this type of connection.

It is believed that the most efficient means of utilising the connecting capacity of a nail is by designing a joint which applies shear loading to the nail. In timber framework assemblies pure shear can be achieved by using metal straps and nailing. Semi-shear can be achieved by skew nailing. Both these methods cannot achieve the allowable shear of the nail because of the lack of strength of the timber. In the known framework assemblies which utilise steel C-channel members as previously described, this form of connection is not viable. The nail passes through the flange of the C-channel member plate into the flange of the mating C-channel member stud and likewise a nail can be installed in the opposite side. The nail twists and disengages from the mating flanges under loading that pulls the stud away from the plate in a direction parallel to the longitudinal axis of the stud. Therefore it is desirable to have steel structural members which have inherent design features that allow effective connections to be made by using the shear capacity of the fasteners, preferably nails, whereby there are at least two distinct points of shear loading along a single nail.

When such framework, as previously described, is used in walling applications which have cladding, it is known that wind loading on the cladding causes horizontal reaction forces to occur between the flange of the end of the stud member and the flange of the plate member immediately adjacent the bend radius of the plate members furthest from the windward face of the framework. This concentration of forces can cause the opposing flange of the plate member to "open up", bearing failure of the contacting stud end corners and adding extra loading on the stud to plate connections. Therefore it is desirable to provide steel structural members and connections therebetween which distributes these reaction forces so as to not cause failure of the framework.

In the design of roll formed steel members minimum bend radii are required to minimise cracking of the bend during the roll forming process. Such minimum bend radii reduces the strength of joints under load application where the joints comprise stud and plate members in which the stud members nest against the tops of the bend radii of the plate members. This applied compression loading causes the flanges of the plate members to deform outwardly as the bends in the plate members deform under the forces from the flanges of the stud members. A known method of plate design which provides uniform support to the cross-section of the stud member is to form the radii into the base of the flanges of the plate members with the radii causing bulges outwardly of the plane of the flanges. This plate design causes installed cladding such as wall linings, preferably plasterboard, to stand proud of the plane of the wall face where the wall lining extends past the web of the plate members and when the plate members are notched and used as head and sill members in door and window openings respectively. Therefore it is desirable to overcome this problem by protruding the bend radii of the plate members, which results in the bulges extending from the plane of the webs and not the plane of the flanges.

When the framework is used as wall frames in tiled roof domestic housing buildings, the preferred means of joining the framework, as previously described, to concrete slabs and the like to provide holddown to resist overturning and bracing loads, is by nailing masonry nails through the bottom plate members into the concrete slab. When using the C-channel steel frame members the hammer driven masonry nails require additional installation support which is usually provided by driving the masonry nails through a timber block which fits into the C-channel. Without the timber block it is difficult to hammer the nails due to the high impact force required to penetrate the plate web when it is in direct contact with the concrete slab because the normal nail piercing action is hindered and because of the associated safety issues with nail mishits.

In sheeted roof domestic construction other fasteners such as chemsets®, dynabolts®, cast in bolts and other forms of pre-drilled fasteners are used to provide holdown to concrete slabs. Large washers are used to transfer the restraining forces of these fasteners to the adjacent flanges when the fasteners are installed adjacent to the stud to plate connection joints. Thus it is seen that it is desirable to provide a means by which a masonry nail or other fastening means can be easily installed without additional nail support such as a timber block and to reduce the requirements for washers in the connections as described in the above installations.

It is widely accepted in domestic construction trade work that nailing is the most cost efficient means of fixing architraves and skirting and is accomplished usually by means of pneumatic or gas powered nailing guns. The only known method to achieve this method of fixing the architraves and skirting is to use a timber infill to the window and door openings and timber blocks to the bottom wall plate members in order that the nails are fully supported, other than using costly alternatives such as screwing and the like. Thus it is deskable to have a framework which does not require timber infills or blocks while maintaining the cost effectiveness of the preferred gun nailing method for fit out of the construction.

In timber framework construction it is common practice to skew nail connections, for example, ceiling joist to top plate, jack, creeper and hip rafter to top plate. In similar constructed frames using conventional C-channel members skew nailing through the webs of the of the C-channel members cannot be achieved because it is impossible to drive a nail through at an angle to the flat web. The same also applies to the flat flanges of the C-channel members. This inability to be nailed at an angle is usually overcome by installing an angle bracket which provides a fixing point and support for the nail via the base of the bracket and a screwed connection through the vertical bracket leg into the web of the C-channel members. It is therefore desirable to have a structural member which allows for skew nailing.

Where joints are formed between stud members and sill members and stud members and window and door head members, the head or sill members are normally plain unlipped C-channel notched at both ends. The ends of the web of C-channels are notched to allow the remaining tags of the flanges to encase the stud member so that there is a flange to flange connection at both sides of the stud members. Joints formed in this way have diminished lateral rigidity against loading applied in the plane of the web of the sill/head members perpendicular to the longitudinal axis of the sill/head members. This is because the elements that form the remaining tags have small flexural rigidity in the plane of loading and the lateral deflection will increase due to assembly clearances which frequently occur between the notched webs of the sill/head members and the webs of the adjacent stud members.

Such lateral loading on the sill/head members cause tensile stresses in the remaining tags on the same side of the applied loading causing shear loading on the flange to flange connection. To overcome this problem angle brackets are used provide the connection between the webs of the sill/head members and the webs of the stud members. This proves to be uneconomical due to the double fastening which is used. Therefore it is desirable to have connections or joints which are formed from partial notching of the web elements of the plate members to form rigid head or sill connections, and stud structural members to form rigid stud to plate connections enabling interlocking of the web elements in addition to encasing the mating structural members by the flange elements.

It is also desirable to provide the plate members with partial web notchings so that the protrusions of the web sections can nest and interlock with the corresponding web intrusions of the stud members.

In the construction of domestic buildings and the like a major labour and material cost is incurred in the assembly of the wall frames. This assembly usually takes the form of a manufacturing process which involves jigging of the wall frame to hold dimensional and shape characteristics while the fastening of the joints or connections occur which is generally semi-automatic.

In the assembly of timber frames the manufacturing process involves the use of a series of pneumatically operated nail guns to join the plate members to the stud members, usually one stud at a time. This process usually involves firing 2 of 75 mm long 3.08 mm diameter nails or similar into the joint formed at each end of the stud members whereby each stud requires four nails.

In the assembly of steel structural members into wall frames many different methods of manufacture are known. These methods include welding, screwing, riveting, clinching and using a built in fastening system such as corresponding tabs and slots. The effectiveness of the tab and slot form of assembly decreases as the thickness or gauge of the structural member decreases and the material costs associated with the tab and slot form is great due to the manufacturing process of forming the tabs. Welding is not suitable for steel gauges less than 0.75 bmt and there are further costs associated with repair of damaged surfaces. This has resulted in the non viability of welding as the form of connection. Clinching and other forms of connections have high costs associated with their semi-automation so these methods are usually applied manually which thereby increases the labour content of the costs of manufacture.

Therefore it is seen that it is desirable to have a means by which the manufacturing of steel wall frame can be assembled more economically than known methods.

OBJECT OF THE INVENTION

Therefore it is the object of the invention to provide a wall flaming system including the types of components used and the method of their assembly, which substantially overcomes or ameliorates the above mentioned disadvantages with known systems. At the very least the object of the present invention is to provide an alternative to known systems.

DISCLOSURE OF THE INVENTION

According to one aspect of the present invention there is provided an elongate wall frame member comprising: a web portion having a central channel and two base portions on either side of said channel; two side edge flange portions both extending substantially perpendicularly and in the same direction from outer side edges of said base portions; said central channel in said web portion projecting in the same direction of the two side edge flange portions; wherein at least one end of the elongate wall frame member has part of its said web portion notched therefrom so that said elongate wall frame member can be joined at its end to a position along the length of a perpendicularly abutting other said elongate wall frame member whereby the part of said web portion notched therefrom corresponds to either the central channel or the two base portions of the web portion when so joined.

In one preferred form the part of the web portion that is notched is the central channel, this preferred form being used as a so called stud member while in another preferred form the part of the web portion that is notched are the two base portions, this preferred form being used as a so called plate member.

Preferably, the flange portion of the stud member is bent with a stiffener portion extending inwardly at right angle to the flange portion.

Preferably, the depth of the central channel of the stud and plate members corresponds to the depth of the notches of the corresponding plate and stud members respectively, whereby the stud and plate flange portions slide and rest against adjacent surfaces each other when the stud or plate member is positioned, in this particular use, perpendicularly thereto.

In a preferred form, the bend radii of the flange portions connecting to the base portions protrudes from the surface of the base portions in an opposite direction to that of the flanges portions.

According to another aspect of the present invention there is disclosed a wall frame system comprising a plurality of substantially parallel spaced stud members as previously described, and at least two plate members as previously described connected to the end extremities of the parallel stud members by connection means.

In the preferred form, the stud members and the plate members are joined by using nails as the connection means. Other forms of connection means are also within the scope of the present invention.

In the preferred form, the wall frame system is connected to masonry and other building materials by nails as the preferred connection means.

According to another aspect of the present invention there is disclosed a method of assembly of a wall frame system as previously described, wherein the method comprises the steps of forming the stud members and plate members in the desired configuration of framework, applying said framework to assembling means, and operating said assembly means to insert the connection means into the joints between the stud members and the plate members. Preferably the connection means are nails.

BRIEF DESCRIPTION OF THE DRAWINGS

One embodiment of the present invention will now be described with reference to the drawings in which.

BEST MODE OF CARRYING OUT THE INVENTION

Figure 14:
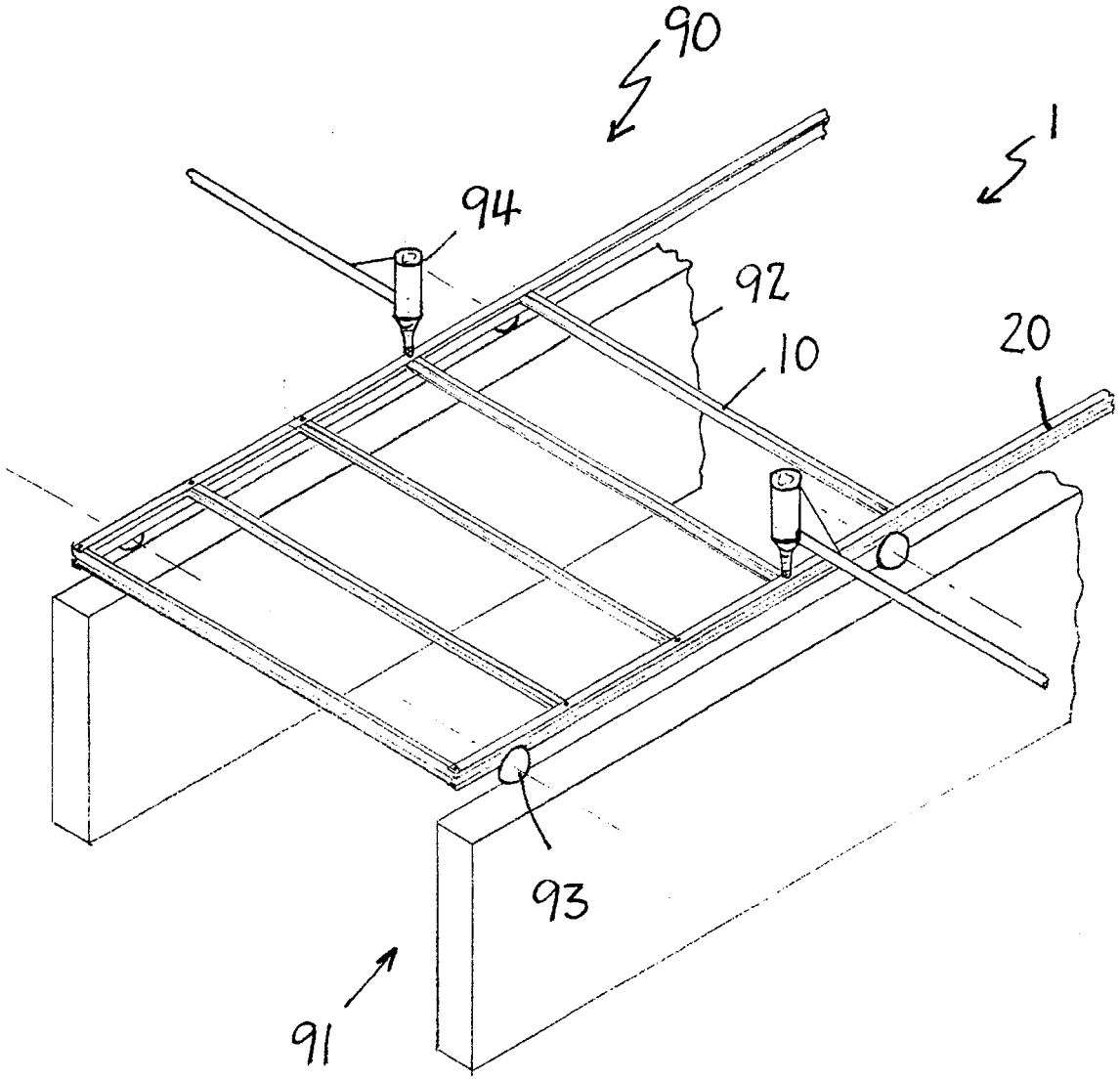
FIG. 14 is a perspective view of the wall frame assembly apparatus.

The framework 1 as seen being assembled in FIG. 14 includes a number of elongate parallel stud members 10 and two elongate plate members 20 connected to the end extremities of the stud members 10. The stud and plate members 10 and 20 are preferably made from cold rolled steel and are illustrated in FIGS. 1–4. As seen from the transverse cross-sectional views, the stud and plate members 10 and 20 respectively have a web portion 11, 21 with a central channel 12, 22 and two base portions 13, 23 on either side of the channel 12, 22. Extending perpendicular to and in the same direction from the outer side edges of the base portions 13, 23 are two flanges 14, 24. In the case of the stud member 10 the flanges 14 each have stiffener portions 15 which extend inwardly and perpendicular to the flanges 14. These stiffener portions 15 can be made using only minor modifications to a roll former (not illustrated). The stiffener portions 15 have a depth that matches the width of the base portions 23 of the plate member 20.

The plate member 20 has protruding ribs 26 whereby the bend radii at both side edges of the base portions 23 protrude outwardly from the outer surface of the base portions in a direction opposite to the direction of the flanges 24. It is noted that the stud member 10 does not have corresponding ribs in this embodiment, however, it is within the scope of this invention for stud member 10 to have same.

Figure 1:
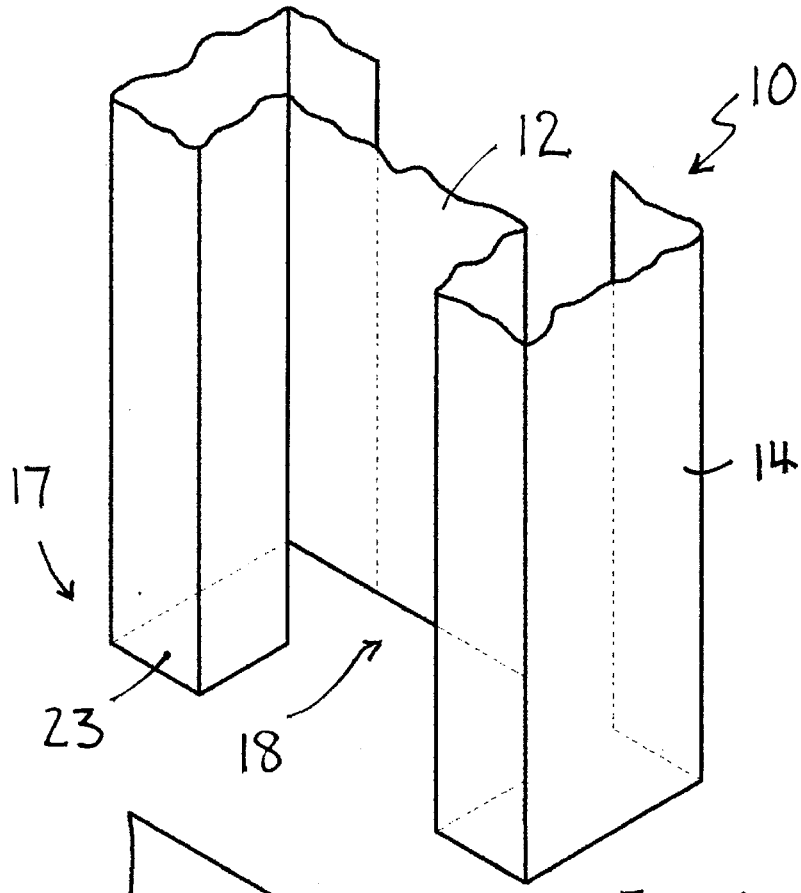
FIG. 1 is a partial perspective view of an elongate stud member of the preferred embodiment shown with part of the web notched at one end thereof.
Figure 2:
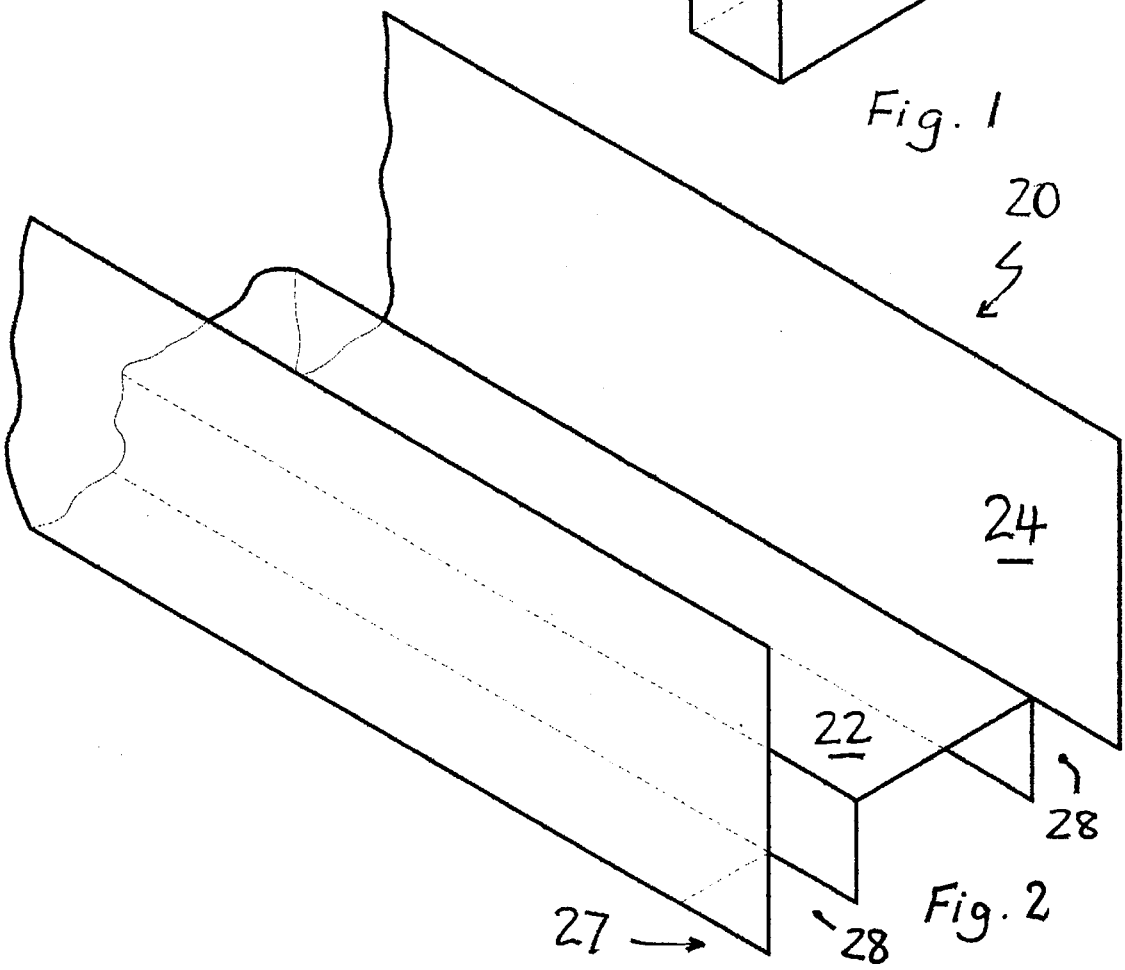
FIG. 2 is a partial perspective view of an elongate plate member of the preferred embodiment shown with part of the web notched at one end thereof.
Figure 3:
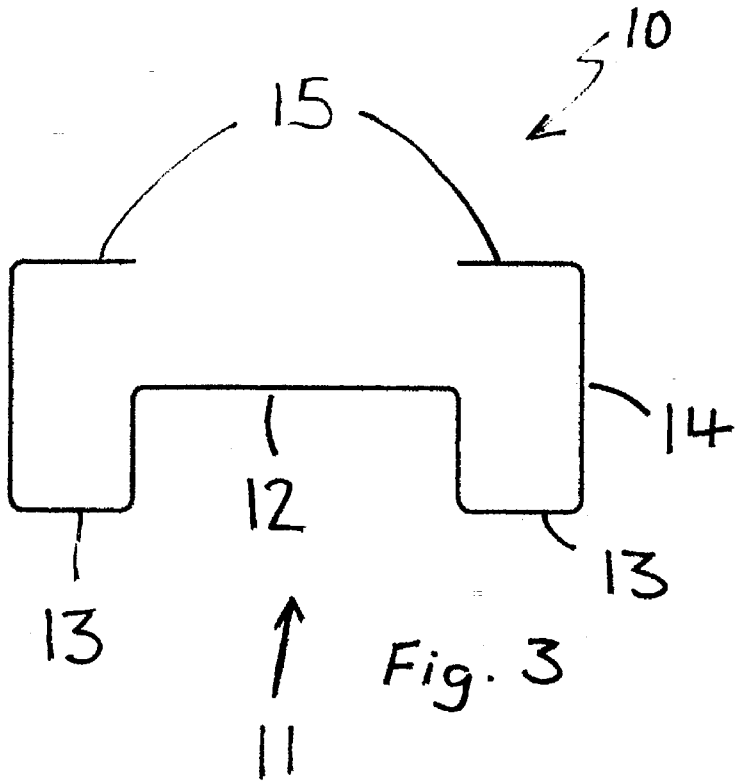
FIG. 3 is a transverse cross-sectional view III—III of the stud member of FIG. 1.
Figure 4:
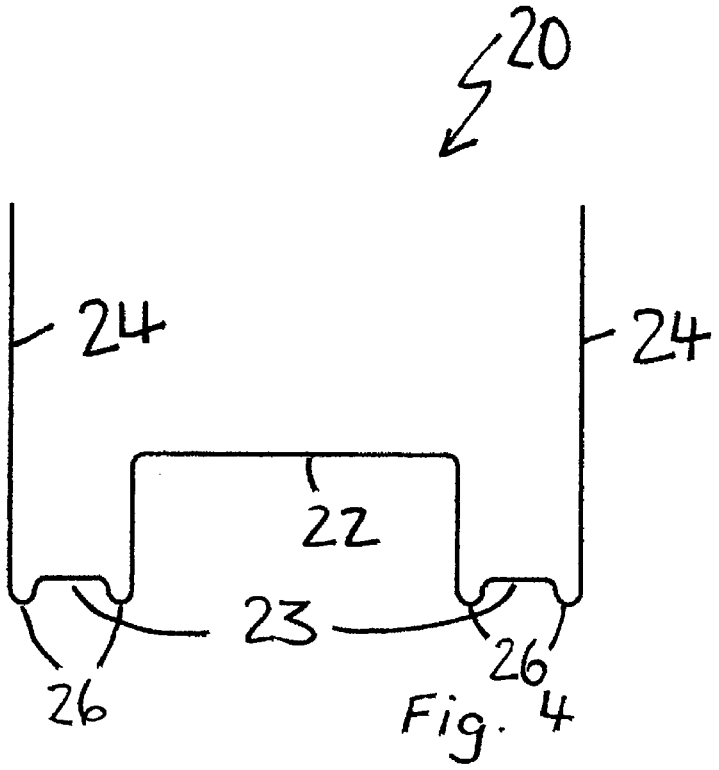
FIG. 4 is a transverse cross-sectional view IV—IV of the plate member of FIG. 2.

The stud and plate members 10, 20 as illustrated in FIGS. 1 and 2 are shown to have parts of their web portions 11, 21 at the ends 17, 27 respectively notched therefrom. These notches 18, 28 are taken from the central channel 12, and base portions 23 respectively. The notches 18, 28 allow the ends 17, 27 to nest or abut against the other type of member when positioned perpendicularly thereto. The notches 18, 28 have depths corresponding to the depth of the channels 22, 12 of the plate and stud members 20, 10 respectively.

Figure 5:
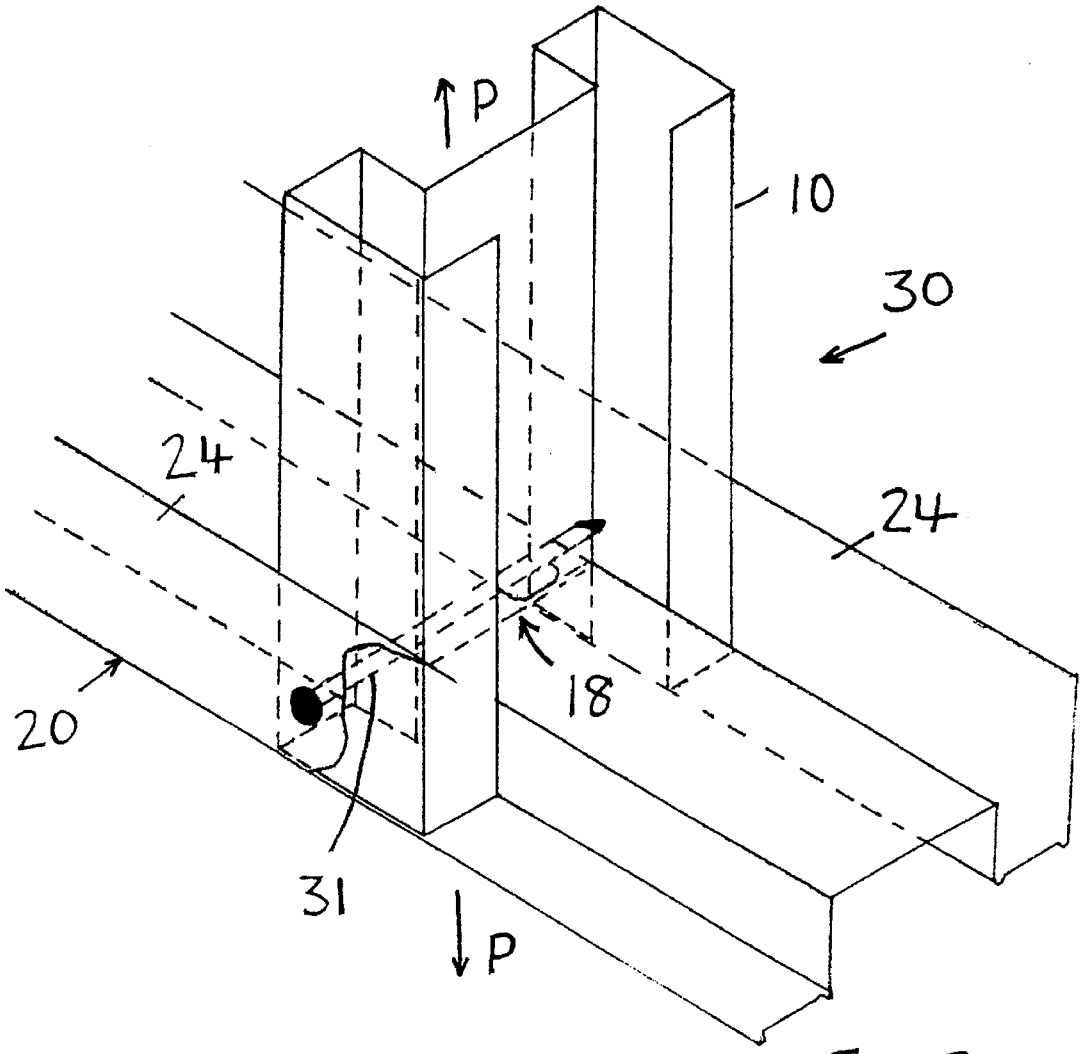
FIG. 5 is a cutaway partial perspective view of the connection of the stud member of FIG. 1 to the plate member of FIG. 2.
Figure 6:
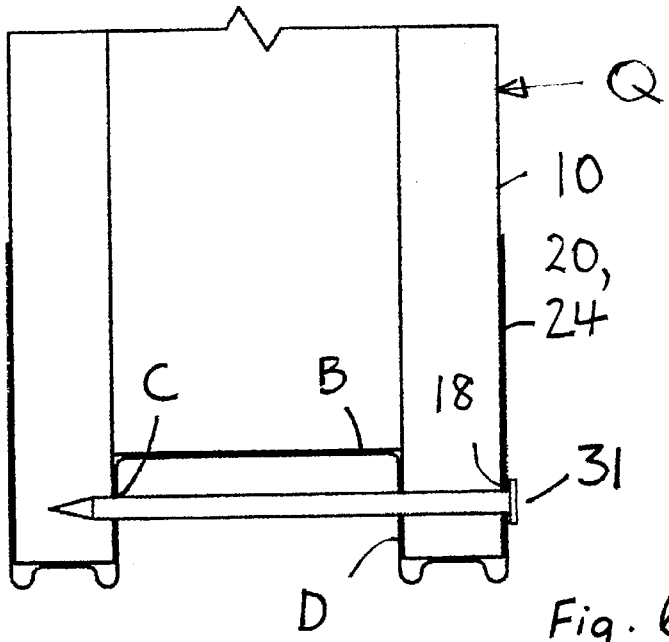
FIG. 6 is a cross-sectional view VI—VI of FIG. 5.

The connection 30 between the end 17 of the stud member 10 and the open side of the plate member 20 is shown in FIGS. 5 and 6. The end 17 of the stud member 10 nests between the flanges 24 of the plate member 20. The notch 18 allows the end surface to abut neatly against the inside contoured surface of the plate member 20. It is seen that the dimensions of the respective portions of the stud and plate members 10, 20 are such that they nest together.

The connection 30 is made by a nail 31 which passes through the stud and plate members 10, 20 at locations A, B, and C. These are three locations of shear load transfer between the stud member 10 and the plate member 20 when the loading is in the direction of arrow P in FIG. 5. This method of connection allows for the nailed connection between stud to plate, as well as plate to jamb stud and head to door jamb stud (as will be discussed later) from just one side of the frame 1, whereas conventional frame assembly requires that the two sides of the frame to be accessible so that these connections can be made. FIG. 6 also shows the surfaces D and E of the plate member 20 upon which the stud member 10 bears under horizontal shear loading in the direction of arrow Q.

The maximum shear capacity is developed because the nail 31 is stabilised from rotation at the points A, B and C along its shank. If the nail is shorter than the nail 31 and does not penetrate at point C there are two points of stabilisation. In this case an additional nail could be required on the opposite side to penetrate the flanges 14, 24 at location F and C in a like manner to complete the connection. This is known to increase the shear capacity of the connection 30 by 33% over that strength achieved by applying a single nail 31 as previously described. Similarly further points of shear capacity can be developed by using more nails. It is also possible to increase the strength of the connection by providing a number of mating or intermeshing ribs (not Illustrated) in the web portions 11, 12.

The substantially z-type arrangement of the central channels 12, 22 with their vertical portions are important in the transferring of lateral forces when connected to another member with corresponding partially notched web portions. The partial notching of notches 18 of the channels 12, and notches 28 of the base portions 23, as different from the full notching of the prior art, help form the rigid connections and also assist in providing strength to the connections which is unavailable in the prior art due to the fact that greater notching is required to make the connection. This method of connection could be applied to all types of joints formed from sections having web and flange portions, whereby the partial notching of the web portion provides greater rigidity and strength than existing forms of connections. This form of connection can be used in truss web to truss chord connections or like connections.

Figure 8:
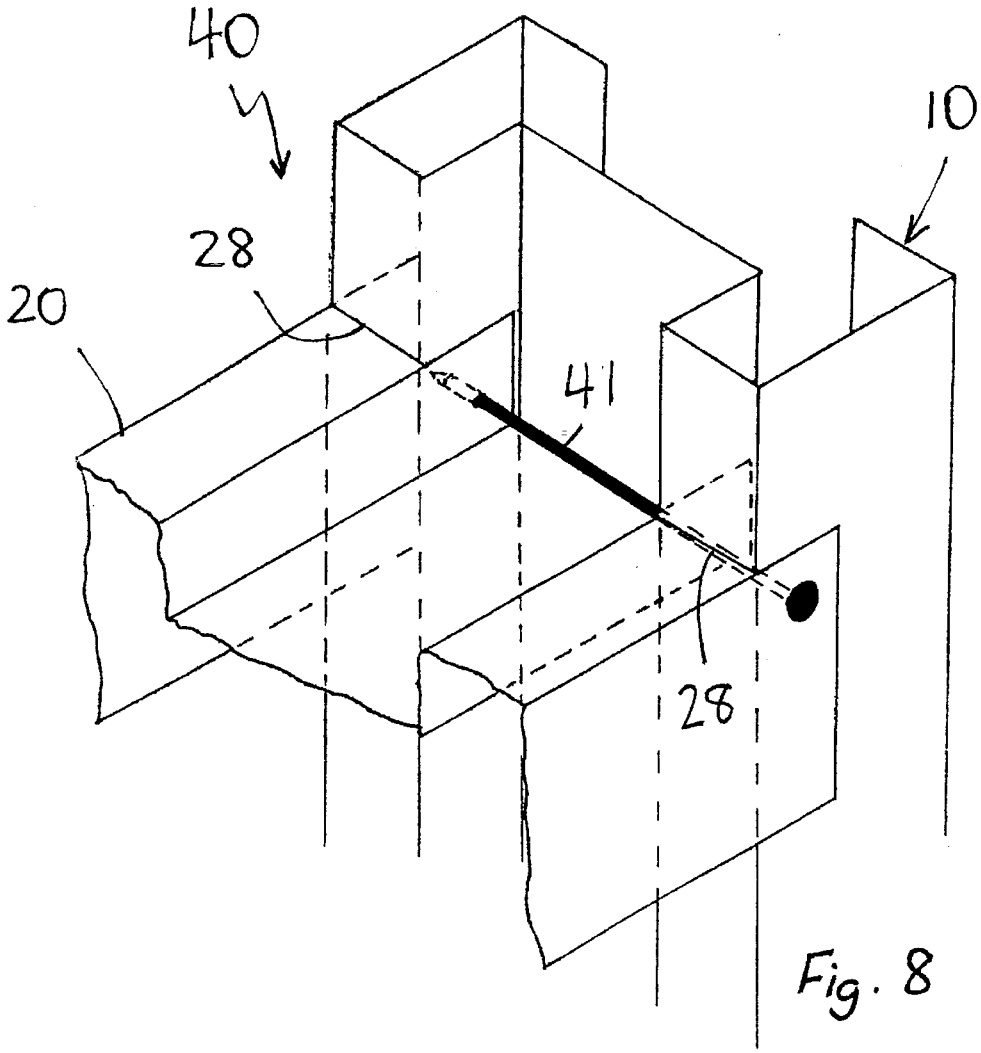
FIG. 8 is a cross-sectional view VIII—VIII of FIG. 7.
Figure 7:
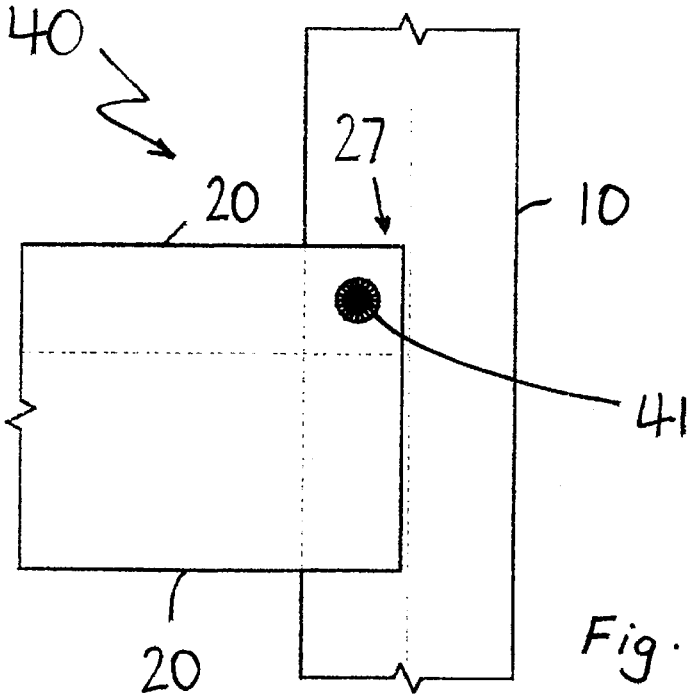
FIG. 7 is a cutaway partial perspective view of the connection of the plate member of FIG. 2 to the stud member of FIG. 1 as when connected to form a window head and sill, or door head.

The connection 40 between a plate member 20 to a stud member 10 is shown in FIGS. 7 and 8. This connection 40 is typically for window head, sill and door head installations. In this arrangement as shown, the notches 28 in the plate member 20 nest around the base portion 13 of the stud member 10. A nail 41 is installed in a similar manner to the previously described connection 30. This connection 40 has a high degree of rigidity as the surfaces of the end extremity 27 of the plate member 20 abut against the outside surface of the stud member 10.

Figure 9:
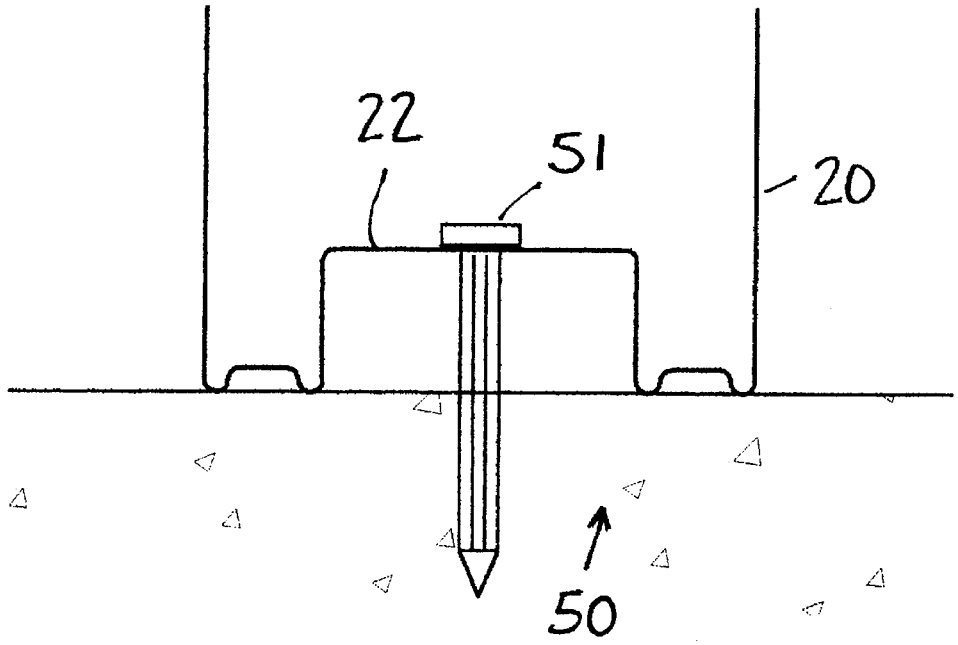
FIG. 9 is a schematic cross-sectional view of the plate member of FIG. 2 being connected to a concrete slab, shown with a nail as the means of connection.
Figure 10:
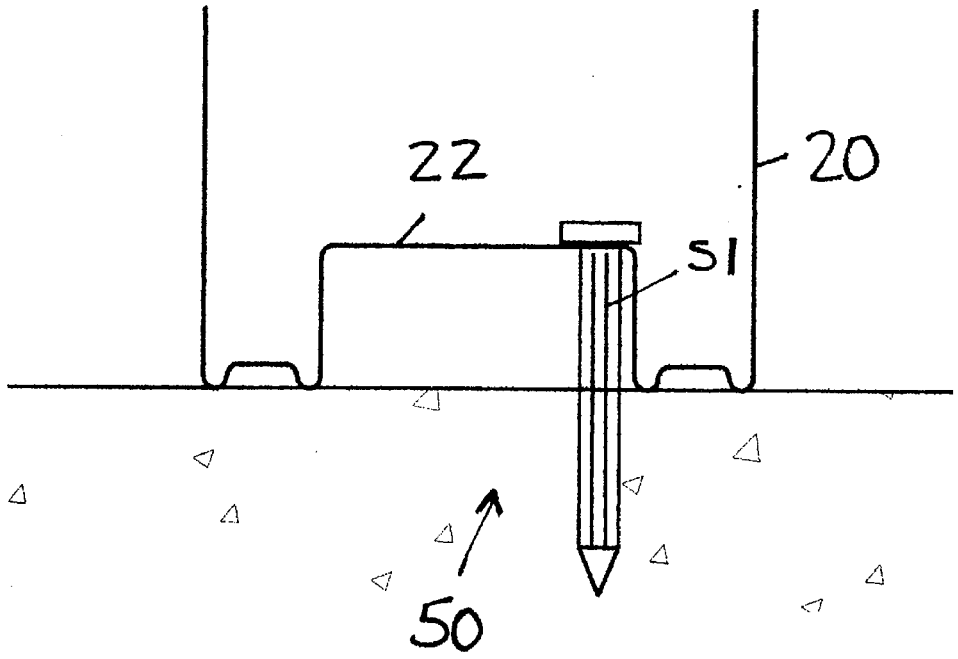
FIG. 10 is a similar view to FIG. 9 with the nail connection shown at an alternative location.

In FIGS. 9 and 10 a plate member 20 is shown connected to a concrete slab 50. A masonry nail 51 is used through the central channel 22. This means that the penetration of the web portion 21 is accomplished at the top of the central channel 22 prior to the nail 51 embedding itself into the slab 50. This enables the nail 51 to be supported when high impact forces are applied in the final concrete nailing step. The substantially z-type arrangement of the channel 22 provides a means of transferring the fastener restraining forces into the shear point B and C (FIG. 6) when the nail 51 is installed near the stud to plate member connection 30 as is standard practice. This connection does away with the need for a washer when the nail 51 is installed near the side of the channel 22 as shown in FIG. 10. This type of connection negates the need for timber blocks as used in the prior art and can be used for other foundation types as required.

Figure 11:
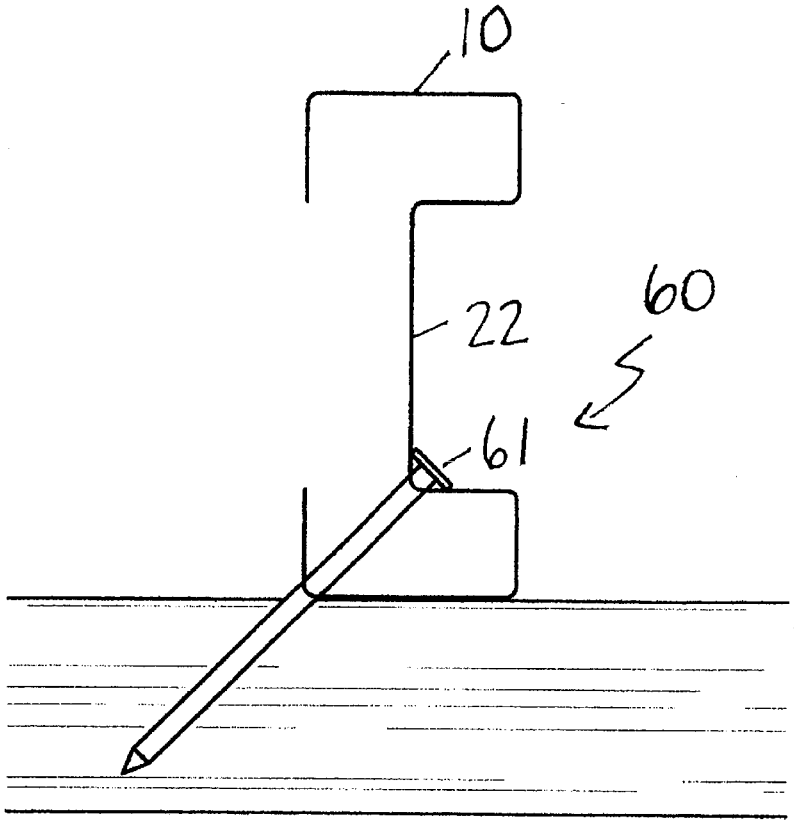
FIG. 11 is a schematic cross-sectional view of the stud member of FIG. 1 being connected to a timber or steel member shown with skew nailing as the means of connection.

In FIG. 11 a skewed nail connection 60 is illustrated. It is seen that if skewed nailing is required in a building that the shape of the stud member 10 (and plate member 10) allows for a nail 61 to be so installed without the need for angle brackets and the like. The skewed nail 61 also provides additional support to the channel 12 against collapsing under vertical loading.

Figure 12:
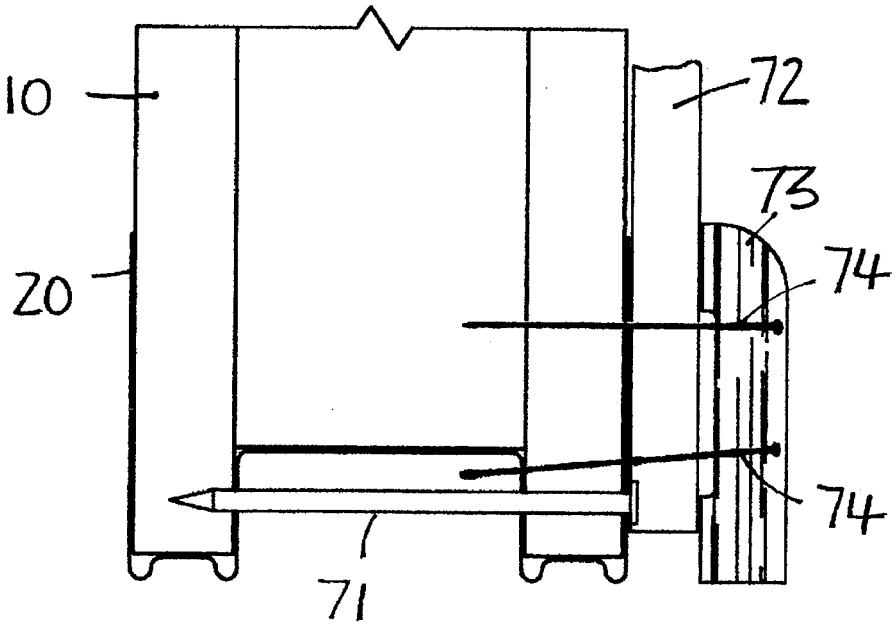
FIG. 12 is a schematic cross-sectional view of the stud member of FIG. 1 being connected to the plate member of FIG. 2 showing skirting nailing.
Figure 13:
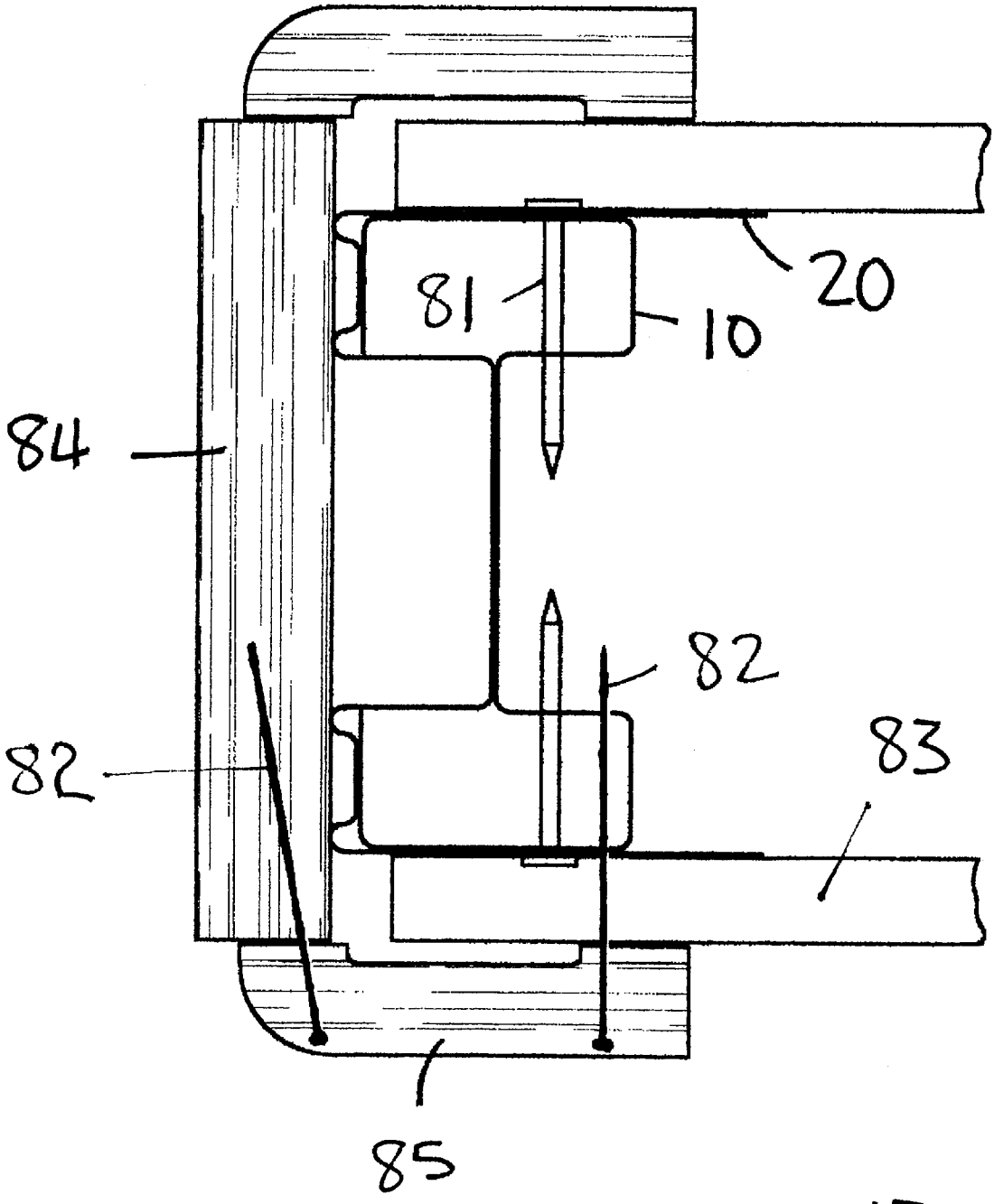
FIG. 13 is a schematic cross-sectional view of the stud member of FIG. 1 being connected to plate member of FIG. 2 showing architrave fixing to doors and windows.

In FIG. 12 a stud member 10 is shown connected to a plate member 20 with a nail 71. In this application plasterboard lining 72 and a skirting board 73 are fixed to the connected stud member 10 and plate member 20 by means of nails 74 which are forced through the skirting board 73 and lining 72 into the stud member 10 and plate member 20 as shown. The configuration of the stud and plate members 10, 20 provides support to the nails 74 which overcomes the necessity of requiring timber infills when nailing.

When the stud member 10 and the plate member 20 are used in door and window openings the stud and plate members 10, 20 are formed into a boxed section as illustrated in FIG. 6, where the stud member 10 sits on top of the plate member 20 as opposed to nesting therein. Nails 81 are used to connect the stud member 10 to the plate member 20 with the resulting number of connection points, while other nails 82 are used to connect a timber window reveal or door jamb 84 and architrave 85. A plasterboard lining 83 is shown positioned between the stud member 10 and the architrave 85. This arrangement facilitates hammer driven nailing.

An assembly apparatus 90 is illustrated in FIG. 14 which shows the frame assembly process which is used in the manufacturing of the wall frames 1 prior to transportation to a building site. The apparatus 90 includes a jig 91 which has a frame 92 on which the assembled frame 1 transverses on rollers 93 on the frame 92. Air operated nail guns 94 are positioned adjacent the frame 92 and installed in the connections between the stud and plate members 10 and 20. Any other type of nail gun or like device can also be used. Due to the arrangement and interconnection of the stud and plate members of the present invention, the fasteners, and in this case nails, are easily inserted from one side of the frame 1. It is not possible for existing arrangements of metal frame members to have their fasteners installed from only one side as it is necessary for the fasteners to be installed from both sides of the frame 1. This feature of the present invention provides advantages in the fabrication thereof in respect of costs of capital equipment and time and ease of fabrication.

The foregoing describes only one embodiment of the invention and modifications obvious to those skilled in the art can be made thereto without departing from the scope of the present invention.

I claim:

1. A wall frame system, comprising:

at least two elongate stud members and at least two elongate plate members, said stud members and plate members comprising:

a web portion having a central channel and two base portions on either side of said central channel; and, two side-edge flange portions, each extending substantially perpendicularly and in a similar direction from outer-side edges of said base portions, said central channel in said web portion projecting in a similar direction as the two side-edge flange portions, wherein, at least one end of each of said stud members has part of its said central channel notched therefrom and at least one end of each said plate members has part of both said base portions notched therefrom, said stud members being joined at their ends abutting said plate members, wherein said part of said central channel of said stud member notched therefrom corresponds to said central channel of said plate member, said plate members being joined at their ends to perpendicularly abut said stud members, whereby said part of said two base portions of said plate member notched therefrom corresponds with said base portions of said stud members.

2. The wall frame system according to claim 1, wherein said central channel is substantially U-shaped with two sides parallel to said side-edge flange portions.

3. The wall frame system according to claim 1, wherein depth of said central channel of said stud members and said plate members corresponds to depth of the notches of corresponding plate members and stud members, respectively.

4. The wall frame system according to claim 1, wherein said flange portion of said stud member is bent with a stiffener portion extending inwardly at a right angle to said flange portion so that it abuts against said central channel of said plate member.

5. The wall frame system according to claim 4, wherein said central channel and said stiffener portion of said stud member facilitate skewed fastening means.

6. The wall frame system according to claim 1, wherein said stud members are joined at their ends to perpendicularly abut said plate members.

7. The wall frame system according to claim 1, wherein a curved projection of said flange portions connecting to said base portions protrudes from said base portions in a direction opposite to that of said flange portions.

8. The wall frame system according to claim 1, wherein said at least two plate members are connected to the ends of said at least two stud members by connection means.

9. The wall frame system according to claim 8, wherein said stud members and said plate members are joined by using a single nail as said connection means.

10. The wall frame system according to claim 8, wherein said stud members and said plate members are joined by using a plurality of nails as said connection means.

11. The wall frame system according to claim 8, wherein said stud members and said plate members are connected to building materials by fastening means.

12. The wall frame system according to claim 11, wherein said fastening means are nails.

13. The wall frame system according to claim 12, wherein said nails are applied to said central channel of said web portion adjacent to the sides of said central channel.

14. The wall frame system according to claim 13, wherein said central channel and said two side-flange portions of said plate members provide support for said nails.

* * * * *